United States Patent [19]

Benthin

[11] 4,087,871

[45] May 9, 1978

[54] VENTILATED TOILET

[75] Inventor: Johannes Benthin, Bremerhaven, Germany

[73] Assignee: MFB Neuwerk Mechanische Fensterbehaenge GmbH, Bremerhaven, Germany

[21] Appl. No.: 664,805

[22] Filed: Mar. 8, 1976

[30] Foreign Application Priority Data

Mar. 7, 1975 Germany ..... 2509946

[51] Int. Cl.[2] ..... E03D 9/05; A47K 13/30

[52] U.S. Cl. ..... 4/217

[58] Field of Search ..... 4/72, 7, 209, 209 FF, 4/211, 213, 216, 217; 98/33 R; 417/315; 415/148, 149 A

[56] References Cited

U.S. PATENT DOCUMENTS

| | | | |
|---|---|---|---|
| 900,831 | 10/1908 | Charlton | 4/217 X |
| 2,047,067 | 7/1936 | Harris | 4/216 X |
| 2,285,161 | 6/1946 | Jenn | 417/315 X |
| 2,373,497 | 4/1945 | Paiste | 417/315 |
| 3,154,793 | 11/1964 | Congdon | 4/217 |
| 3,594,826 | 7/1971 | Maurer | 4/7 |
| 3,887,949 | 6/1975 | Osmond | 4/217 |
| 3,953,901 | 5/1976 | Poister et al. | 4/217 X |

*Primary Examiner*—Richard E. Aegerter
*Assistant Examiner*—Stuart S. Levy
*Attorney, Agent, or Firm*—Michael J. Striker

[57] ABSTRACT

A ventilated toilet has a toilet bowl and a toilet seat hingedly mounted on the toilet bowl. A blower is mounted in a casing and includes a blower housing which has inlet and outlet ports at the inlet and outlet sides of the blower. The blower is mounted in the casing for pivoting between two positions in one of which a channel which extends between the blower housing and the internal space of the toilet bowl communicates with the inlet port so that the blower withdraws air from the internal space, and another position in which the channel communicates with the outlet port so that the blower forces air, which may be heated during its passage through the channel, into the internal space of the toilet bowl. The port which does not communicate with the channel simultaneously communicates with the ambient atmosphere. A return spring may be provided which urges the housing toward one of the positions thereof, and the housing may be displaced into the other position against the action of the return spring by an actuating lever via a gear transmission, and arrested in such other position. The actuating lever may also control other arrangements, such as the air-heating arrangement and the drive for the blower.

19 Claims, 4 Drawing Figures

VENTILATED TOILET

BACKGROUND OF THE INVENTION

The present invention relates to toilets in general, and more particularly to such toilets in which the interior of the toilet bowl is ventilated.

There are already known toilets which are equipped with a spraying arrangement in the interior of the toilet bowl, and in which a blower is arranged at the toilet bowl and operatively connected with the interior thereof by means of at least one channel which may be provided either in the toilet seat or in the toilet bowl itself, or partly bounded by the toilet seat, on the one hand, and by a portion of the toilet bowl, on the other hand. This type of blower arrangement is used for introducing drying air into the interior of the toilet bowl in order to dry such surfaces which have been previously wetted and cleaned by the spray. In one of such blower arrangements used in connection with a toilet, the incoming air for the blower is pre-heated by a heating arrangement, and the heating arrangement as well as the motor which drives the blower are energized by means of one or more switches which are arranged in the circuits of the heating arrangement and of the driving motor, respectively. The switch or switches may be actuated either manually or by means of a foot-actuated arrangement. The blower, or a plurality of blowers which may be used in such blower arrangement, is accommodated in a cylindrical housing or in separate cylindrical housings, and the channel, or a plurality of distributing channels, communicates with the housing or housings and conducts the heated air toward selected regions of the toilet bowl or of the toilet seat so as to achieve desired and advantageous drying effect.

There are also known different blower arrangements which, instead of introducing pre-heated air into the interior space of the toilet bowl, withdraw air from such interior space. In this arrangement, it is also already known, as it is in connection with the previously discussed blower arrangement, to support the blower arrangement on the toilet bowl rearwardly of the hinged connection of the toilet seat to the toilet bowl. In this type of blower arrangement, the outlet port of the blower is in communication either with a ventilating chute, or with the immediate environment of the toilet bowl, and a filter is provided downstream of the outlet port of the blower in the latter instance. On the other hand, the inlet port of the blower is in communication, via a channel or a plurality of channels, with the interior of the toilet bowl. It is also known to control the operation of the blower of this arrangement by means of a switch which is so acted upon by the toilet seat that the switch closes the circuit of the drive for the blower when the toilet seat is in a lowered position thereof, while the switch opens the circuit of the blower drive as the toilet seat is displaced toward the raised position thereof.

The above-discussed arrangements, while satisfactorily performing the tasks for which they have been constructed have nevertheless a serious drawback which is to be seen in the fact that each of such arrangements has only one mode of operation, that is, the respective blower arrangement can operate either only as an arrangement for introducing heated drying air into the interior space of the toilet bowl, or only as an arrangement for withdrawing air from the interior space of the toilet bowl.

SUMMARY OF THE INVENTION

Accordingly, it is a general object of the present invention to avoid the disadvantages of the prior-art blower arrangements.

It is a further object of the present invention to provide a blower arrangement which can be switched between two modes of operation in a simple manner.

More particularly, it is an object of the present invention to provide a ventilated toilet in which a single blower arrangement can be used for both withdrawing air from the interior space of the toilet bowl and for introducing heated drying air into such interior space.

It is a concomitant object of the present invention to provide a blower arrangement for use in ventilated toilets which is simple in construction and reliable in operation.

Yet another object of the present invention is to provide a blower arrangement for use in ventilated toilets which is extremely simple to operate.

In pursuance of these objects and others which will become apparent hereafter, one feature of the present invention resides, briefly stated, in a ventilated toilet, in a combination which comprises a toilet bowl bounding a space which is to be ventilated; a blower means which has an inlet side and an outlet side; and communicating means for selectively communicating said inlet side and said outlet side of said blower means with said space to thereby withdraw air from and introduce air into said space, respectively.

According to a currently preferred embodiment of the present invention, the blower means includes a blower housing and blower member mounted in the blower housing for rotation, the blower housing being mounted on a support for pivoting between two positions. The blower housing has an inlet port and an outlet port, only one of such ports communicating with a channel which leads into the interior of the toilet bowl in each of the above-mentioned positions of the blower housing. Simultaneously therewith, that port of the housing which does not communicate with the channel is in communication with the environment of the toilet bowl so that the blower means either withdraws air from the interior of the toilet bowl through the channel and the inlet port and discharges the withdrawn air through the outlet port into the ambient atmosphere, or draws air from the ambient atmosphere through the inlet port and discharges the ambient air, through the outlet port, into the channel and thus introduces such air into the interior of the toilet bowl. The blower means is so constructed that the blower member rotates in one and the same direction for both modes of operation of the blower means. A particular advantage of this blower arrangement is to be seen in the fact that only a single blower is to be provided, which performs both tasks, that is withdrawing air from the interior of the toilet bowl and introducing air in such interior. In this arrangement, a simple pivoting of the blower housing through several degrees is sufficient to switch the operation of the blower arrangement between the two above-mentioned modes of operation, one corresponding to withdrawal of air from the interior of the toilet bowl, and the other corresponding to introduction of air into such interior.

Because of the particular construction of the blower arrangement, particularly because of the arrangement of the inlet and outlet ports on the blower housing, it is possible, by pivoting the blower housing between the positions thereof, to achieve the above-mentioned two modes of operation of the blower arrangement. Thus, when the blower housing is in one of the above-mentioned positions, the inlet port thereof communicates with the channel and via the same with the interior of the toilet bowl, while the outlet port communicates with the ambient air, while in the other position of the blower housing the inlet port of the blower arrangement communicates with the ambient air and the outlet port of the blower arrangement communicates with the channel and via the same with the interior of the toilet bowl.

According to a currently preferred structural embodiment of the present invention this is achieved in a simple manner in that the blower housing is cylindrically configurated and is mounted on a support for pivoting about an axis which coincides with the axis of the output shaft of the drive and thus with the axis of rotation of the blower member. It is also proposed according to the present invention to rigidly connect the blower housing with the stator part of the drive for the blower member for shared pivoting about the above-mentioned axis, whereby the blower housing and the stator part of the drive form a unit.

Advantageously, an actuating lever is provided which serves the purpose of pivoting the blower housing about the pivoting axis thereof. It is a further advantage when the actuating lever simultaneously also performs other functions, such as operating the spray arrangement so that, when the actuating lever is moved in one direction, the spraying arrangement is operated and the toilet is flushed, while the movement of the actuating lever in the opposite direction results in a pivoting of the blower housing into its position corresponding to introduction of the heated air into the interior of the toilet bowl, and the drive of the blower member is energized. The last-mentioned pivoting movement advantageously is performed against the action of a return spring so that the return spring automatically returns the blower housing into that position thereof which corresponds to the air-withdrawing mode of operation of the blower arrangement.

A switch which is displaced into its closed position by the toilet seat when the latter is in the lowered position thereof is provided, which switch is arranged in the power-supply circuit of the drive for the blower member, whereby the drive is energized whenever a weight of a user of the toilet rests on the toilet seat, especially when the blower housing is in its position which corresponds to withdrawing air from the interior of the toilet bowl. In this manner, the blower arrangement withdraws air from the interior of the toilet bowl until the housing of the blower is pivoted into the position which corresponds to introduction of heated air into the interior of the toilet bowl so that the heated air is from then on used for drying the surfaces which have become wet as a result of the operation of the spraying arrangement.

It is further advantageous according to an additional feature of the present invention to provide an arresting arrangement which arrests the blower housing in its position corresponding to the introduction of heated air into the interior of the toilet bowl so long as the weight of the user rests on the toilet seat. In this manner, it is possible to only initiate the drying mode of operation of the blower arrangement by displacing the actuating lever and then the drying process continues until the toilet seat is displaced toward the raised position thereof, so that the possibility of the return of the blower housing into its position corresponding to withdrawal of air from the interior of the toilet bowl is excluded during such time period.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
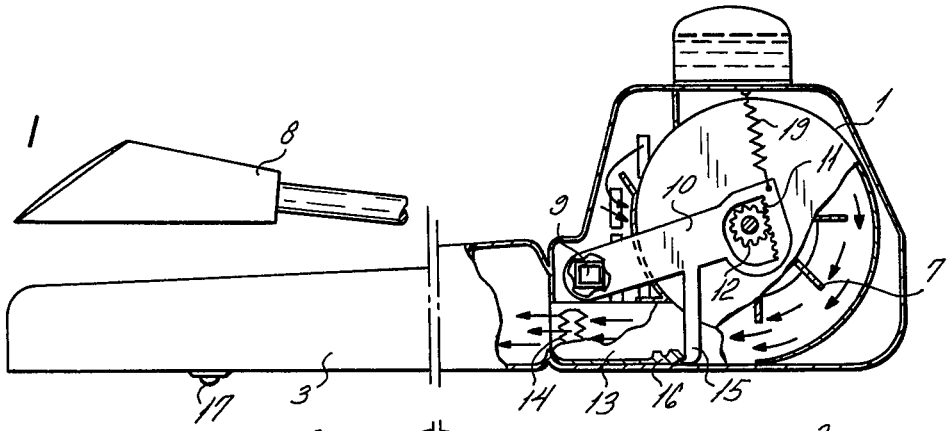
FIG. 1 is a partially sectioned side elevational view of the blower arrangement of the present invention in position thereof in which air is introduced into the interior of the toilet bowl.

Referring now to the drawings in general, it may be seen that the reference numeral 1 indicates a blower arrangement in toto which is supported in a support 2 on which there is also hingedly mounted a toilet seat 3 which cooperates with a non-illustrated conventional toilet bowl. The blower arrangement 1 includes a blower housing 4 which is of a cylindrical configuration and which is coaxial to a drive motor 18 of the blower, such drive motor being of a conventional construction. In the currently preferred embodiment of the present invention the cylindrical blower housing 4 is rigidly connected to the stator part of the drive motor so as to form an operational unit therewith.

The unit, that is the cylindrical blower housing 4 and the stator part of the drive motor, is mounted in the support 2 for pivoting about an axis 5 which coincides with the axis of the output shaft of the drive motor. The unit may be mounted in the support 2, for instance, by means of a pivot pin 6 which is arranged at the support 2 at one side of the blower housing 4, and on the other side of the unit by means of a recess which is conventional and thus has not been illustrated, such recess being formed in a lateral wall of the support 2.

A blower member 7 is accommodated within the cylindrical blower housing 4 which, in the currently preferred illustrated embodiment of the present invention, is formed with inlet and outlet ports penetrating through the circumferential and the lateral walls of the blower housing 4. Such inlet and outlet ports serve the purpose of respectively admitting air into the interior of the blower housing 4, and discharging the air from the interior of the blower housing 4.

Figure 3:
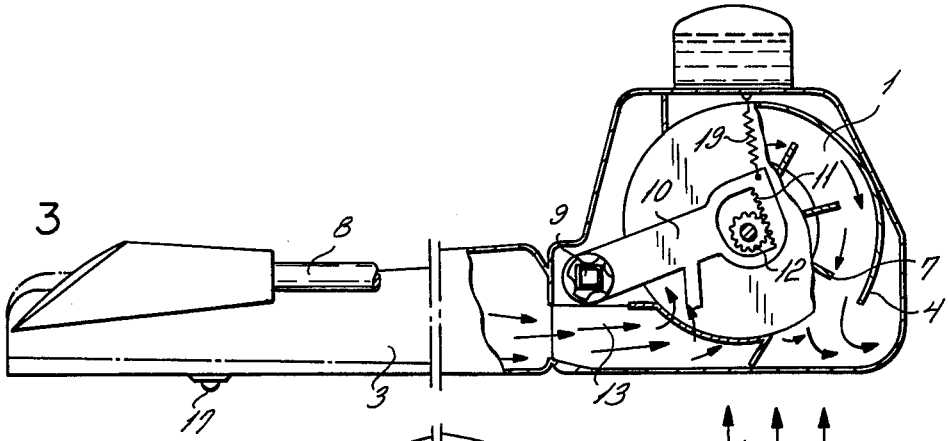
FIG. 3 is a view similar to FIG. 1 but showing the position assumed when the blower is used for withdrawing air from the interior of the toilet bowl.
Figure 4:
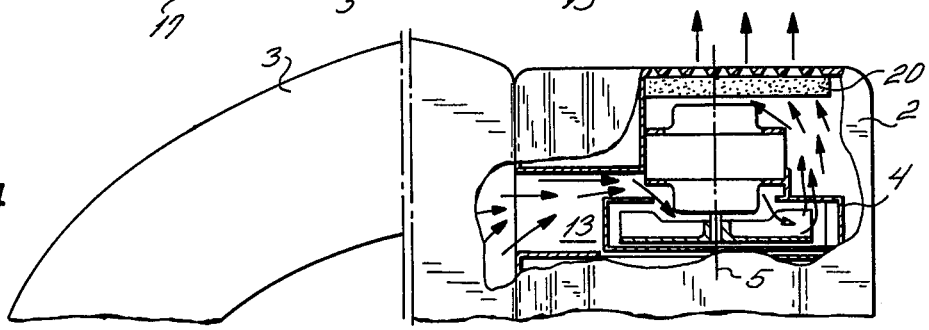
FIG. 4 is a view similar to FIG. 2 in the position illustrated in FIG. 3.

An actuating lever 8 is provided which serves the purpose of pivoting the blower housing 4 about the axis 5. Simultaneously therewith, the actuating lever 8 may also control other functions, such as actuating the spraying arrangement which is of a conventional construction and has not been illustrated. The lever 8 is mounted for pivoting on a pivot 9, and a further lever 10 is mounted on the pivot 9 for shared pivoting therewith, the additional lever 10 being formed with a plurality of teeth 11. A pinion 12 is mounted on the blower housing 4 for shared rotation therewith and the teeth of the pinion mesh with the teeth 11 provided on the additional lever 10. Consequently, the lever 10 moves, from its starting position, simultaneously with the lever 8, between two positions which respectively correspond to two angularly displaced positions of the blower housing 4, due to the fact that the meshing engagement of the teeth of the pinion 12 with the teeth 11 of the additional lever 10 rotates the pinion 12 and thus the housing 4 which is rigidly connected to the pinion for shared rotation therewith about the axis 5. A spring 19 is provided, having one end thereof connected to the support 2 and another end connected to the additional lever 10, the spring 19 urging the additional lever 10, and thus the blower housing 4, towards the position which is illustrated in FIGS. 3 and 4 of the drawing. The support 2 is constructed as an enclosed casing which is provided with inlet and outlet openings which communicate the interior of the casing 2 with the exterior thereof, and another opening which communicates the interior of the casing 2 with a channel which is provided in the toilet seat 3 and which communicates with the interior of the toilet bowl.

Figure 2:
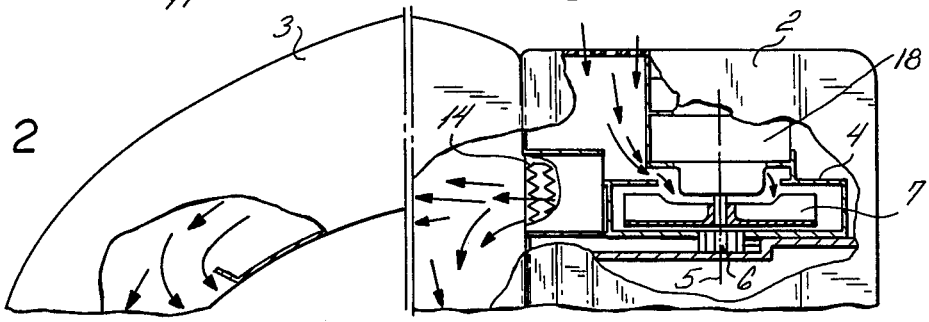
FIG. 2 is a partly sectioned top elevational view of the arrangement in the position illustrated in FIG. 1.

The blower arrangement 1 is illustrated in FIGS. 1 and 2 in the position which it assumes when it is used for admitting heated air into the interior of the toilet bowl. This position is obtained by moving the actuating lever 8 into its position indicated in FIG. 1. In this position of the blower housing 4, the outlet port of the housing 4 is in registry with a channel 13 which is formed in the casing 2 and which communicates with a channel provided in the toilet seat 3. A heating arrangement 14 is accommodated in the channel 13, and the lever 8 can cooperate with a non-illustrated switch interposed in the energizing circuit of the heating arrangement 14 in such a manner that the switch is closed and the heating arrangement 14 energized when the blower housing 4 is in the position illustrated in FIGS. 1 and 2 so that the air introduced to the interior of the toilet bowl is heated during its passage through the channel 13. Simultaneously therewith, the inlet port of the blower housing 4 is in communication with the environment of the blower arrangement 1, particularly with the exterior of the casing 2, as especially seen in FIG. 2.

The blower housing 4 can be arrested in this position, when the weight of a user rests on the toilet seat 3, in such a manner that the additional lever 10 is formed with an extension 15, and a latching element 16 cooperates with the extension 15 so as to arrest the extension 15 in the position illustrated in FIG. 1. In this manner, the extension 15, thus the additional lever 10 and thus also the blower housing 4, are prevented from being displaced by the spring 19 into the position illustrated in FIGS. 3 and 4. A switch 17 is provided on the lower side of the toilet seat 3, which switch 17 is operatively connected with the latching element 16 by means of an electrical circuit which is conventional and thus has not been illustrated. The switch 17 so cooperates with the non-illustrated toilet bowl that, when the seat 3 is in its lowered position the switch 17 causes closing of the electric circuit so that the latching element 16 is placed into its position illustrated in FIG. 1 in which it can engage the extension 15 of the additional lever 10. Simultaneously therewith, the switch 17 can also be used for energizing the motor of the blower arrangement 1.

Once the weight resting on the toilet seat 3 is lifted, the switch 17 causes opening of the electrical circuit so that the latching element 16 is retracted, whereby the extension 15 of the additional lever 10 is released, so that the return spring 19 moves the blower housing 4 and thus also the additional lever 10 and the other components connected thereto into the position which is illustrated in FIGS. 3 and 4.

When the blower housing 4 is in the latter position, the inlet port of the blower housing 4 communicates with the channel 13 and thus with the interior of the toilet bowl, whereas the outlet port of the blower housing 4 communicates with the exterior of the casing 2. An air filter 20 may be provided at the outlet opening of the casing 2 which serves the purpose of purifying the outgoing air. However, the outlet opening of the casing 2 can also communicate with a ventilating chute, in which event the air filter 20 can be omitted.

As already mentioned, the energization of the drive motor is accomplished by actuating the switch 17 due to the fact that the weight of a user rests on the toilet seat which is in its illustrated lowered position. All other operations of the blower arrangement 1 are controlled by the actuating lever 8, in the manner which has been discussed previously.

It will be understood that each of the elements described above, or two or more together, may also find a useful application in other types of constructions differing from the types described above.

While the invention has been illustrated and described as embodied in a ventilated toilet, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A ventilated toilet, comprising in combination a toilet bowl bounding a space; and blower means comprising a support, a housing having an inlet port and an outlet port, an impeller mounted in said housing for rotation about a stationary axis, means mounting said housing in said support pivotably about said stationary axis for movement in a circumferential direction of said impeller for a relatively small angular distance between one circumferential position in which said inlet port of said housing communicates with said space of said toilet bowl and said outlet port of said housing communicates with the environment of said blower means, and another position in which said outlet port of said housing communicates with said space of said toilet bowl and the inlet port of said housing communicates with the environment of the blower means, said impeller aspirating air from said space of said toilet bowl when said housing is in said one position and said impeller directing air into said space when said housing is in said other position.

2. A combination as defined in claim 1, and further comprising communicating means for communicating said ports of said blower housing with said space, said communicating means including a channel extending between said blower housing and said space of said toilet bowl, and means for registering said channel with said ports.

3. A combination as defined in claim 2, wherein said registering means includes means for pivoting said blower housing between said positions thereof.

4. A combination as defined in claim 3, wherein said support includes a casing which surrounds said blower housing and has at least one opening communicating the interior of said casing with the exterior thereof; and wherein one of said ports communicates with said opening when the other port communicates with said channel, and vice versa.

5. A combination as defined in claim 4; further comprising heating means situated in said channel; and means for energizing said heating means, including a switch which closes a heating circuit when said blower housing is in one of said positions thereof.

6. A combination as defined in claim 5, wherein said actuating lever is operative for closing and opening said switch.

7. A combination as defined in claim 3, wherein said blower housing is substantially cylindrical.

8. A combination as defined in claim 7, wherein said blower means further includes a drive for said impeller, said drive including a stator and a rotor; and wherein said blower housing is affixed to said stator for shared pivoting therewith.

9. A combination as defined in claim 3, wherein said pivoting means includes an actuating lever operatively connected with said blower housing.

10. A combination as defined in claim 9, wherein said pivoting means further includes at least one return spring urging said housing toward one of said positions thereof.

11. A combination as defined in claim 9, wherein said pivoting means further includes a transmission interposed between said actuating lever and said blower housing.

12. A combination as defined in claim 11, wherein said transmission includes at least two intermeshing gear members.

13. A combination as defined in claim 12, wherein one of said gear members is a rack, and the other a pinion; and wherein said gear members are rigidly connected to said blower housing and said actuating lever, respectively.

14. A combination as defined in claim 9, wherein said actuating lever is mounted on said support for pivoting between two end positions which respectively correspond to said one and other position of said blower housing.

15. A combination as defined in claim 9, wherein said blower means further includes a drive for rotating said impeller; and further comprising means for energizing said drive, including a power-supply circuit to said drive, and a switch interposed in said circuit and operative for establishing and interrupting supply of power to said drive.

16. A combination as defined in claim 15, wherein said lever is operative for closing and opening said switch.

17. A combination as defined in claim 15, and further comprising a toilet seat mounted on said toilet bowl for displacement between a raised and a lowered position; and wherein said switch is situated between said toilet seat and said toilet bowl and operative for establishing power supply to said drive in said lowered position of said toilet seat, and interrupting such power supply as said toilet seat is displaced toward said raised position thereof.

18. A combination as defined in claim 3; and further comprising means for arresting said blower housing in one of said positions thereof.

19. A combination as defined in claim 18; and further comprising a toilet seat mounted on said toilet bowl for displacement between an operative and an inoperative position; wherein said arresting means includes a latching element mounted on said support for displacement between a retracted position and an extended position; and wherein said latching element is displaced between said extended and retracted positions thereof in response to displacement of said toilet seat between said operative and inoperative positions thereof.

* * * * *